US011957283B2

(12) United States Patent
Oliver

(10) Patent No.: US 11,957,283 B2
(45) Date of Patent: Apr. 16, 2024

(54) RECONFIGURABLE WATER DISTRIBUTION SYSTEM FOR A WALK-IN TUB BATHING INSTALLATION WITH A SINGLE PUMP FOR MULTIPLE FUNCTIONS

(71) Applicant: Daniel Oliver, Linden, TN (US)

(72) Inventor: Daniel Oliver, Linden, TN (US)

( * ) Notice: Subject to any disclaimer, the term of this patent is extended or adjusted under 35 U.S.C. 154(b) by 34 days.

(21) Appl. No.: 17/644,878

(22) Filed: Dec. 17, 2021

(65) Prior Publication Data

US 2022/0110489 A1 Apr. 14, 2022

Related U.S. Application Data

(60) Continuation-in-part of application No. 17/081,881, filed on Oct. 27, 2020, now Pat. No. 11,659,963, which is a division of application No. 16/195,529, filed on Nov. 19, 2018, now Pat. No. 10,874,260.

(51) Int. Cl.
*A47K 3/02* (2006.01)
*A47K 3/10* (2006.01)

(52) U.S. Cl.
CPC . *A47K 3/02* (2013.01); *A47K 3/10* (2013.01)

(58) Field of Classification Search
CPC ..... A47K 3/02; A47K 3/10
USPC ..... 4/541.1
See application file for complete search history.

(56) References Cited

U.S. PATENT DOCUMENTS 210,334 A 11/1878 Kinsmen
1,805,560 A 5/1931 Barta
3,863,275 A 2/1975 Brendgard
4,716,605 A 1/1988 Shepherd et al.
4,907,305 A 3/1990 Teramachi et al.
4,974,310 A 12/1990 Altman
5,012,535 A 5/1991 Klotzbach
5,123,123 A 6/1992 Hart et al.
5,351,345 A 10/1994 Sills et al.
5,570,481 A * 11/1996 Mathis ..... A61H 33/60 200/83 Z (Continued)

FOREIGN PATENT DOCUMENTS

JP 2002364933 A 12/2002

OTHER PUBLICATIONS

American Standard, Drain Overflow Installation, Quick Drain, www.americanstandard-us.com, American Standard (at least as early as Apr. 14, 2015).

(Continued)

*Primary Examiner* — Huyen D Le
(74) *Attorney, Agent, or Firm* — Baker Donelson; Carl M. Davis, II

(57) ABSTRACT

A water distribution system for providing multiple bathing functions independently for a walk-in bath tub using one pump that delivers pressurized water to a first valve having a first outlet for communicating pressurized water to a second valve and a second outlet for communicating pressurized water to a drain, the second valve selectively positioned for communicating pressurized water selectively to a respective piping system for a micro bubbles bathing function and for a pressurized jet bathing function, and a controller for moving the valves selectively to provide three operational bathing functions independently with the one pump. A method for providing multiple bathing functions independently with one pump is disclosed.

30 Claims, 9 Drawing Sheets

(56) References Cited

U.S. PATENT DOCUMENTS

| | | | | |
|---|---|---|---|---|
| 5,604,940 | A * | 2/1997 | Shimizu | A47K 3/10 4/541.1 |
| 5,898,958 | A | 5/1999 | Hall | |
| 7,886,372 | B2 | 2/2011 | Jacobs | |
| 8,407,823 | B2 | 4/2013 | Sorensen et al. | |
| 8,549,678 | B2 | 10/2013 | Neidich et al. | |
| 8,683,622 | B2 | 4/2014 | Ciechanowski et al. | |
| 8,720,867 | B2 | 5/2014 | Cunningham | |
| 9,066,635 | B2 | 6/2015 | Campbell et al. | |
| 10,655,309 | B1 * | 5/2020 | Oliver | E03C 1/23 |
| 10,881,251 | B2 | 1/2021 | Manchiraju | |
| 11,085,178 | B1 | 8/2021 | Oliver | |
| 11,659,963 | B2 * | 5/2023 | Oliver | A47K 3/10 4/541.1 |
| 2005/0005349 | A1 | 1/2005 | Gardenier | |
| 2008/0189847 | A1 | 8/2008 | Yamasaki | |
| 2015/0366752 | A1 | 12/2015 | Hatley | |
| 2016/0271012 | A1 | 9/2016 | Xu | |
| 2017/0285274 | A1 | 9/2017 | Lee | |
| 2020/0154951 | A1 | 5/2020 | Kownacki | |

OTHER PUBLICATIONS

American Standard, Speed Connect.RTM. Drain, www.americanstandard-us.com/learn/american-standard-advantage/innovations- /speed-connect, (at least as early as Apr. 14, 2015).

Safety Tubs LLC, electrical circuit diagrams, 2009.

Safety Tubs LLC, Safety Tubs luxury 60'×32' walk-in tub, www.safetytubs.com/acrylictubs/603237_options.php, Safety Tubs LLC, 902 West, North Carrier Parkway, Grand Prairie, TX 75050 (at least as early as Apr. 14, 2015).

Safety Tubs LLC, Walk-In Bath Installation Instructions and Owner's Manual, pp. 16, 20, and 24, Safety Tubs LLC, 902 West, North Carrier Parkway, Grand Prairie, TX 75050 (at least as early as Apr. 14, 2015).

Saftey Tubs LLC, Minute Drain, Safety Tubs LLC, 902 West, North Carrier Parkway, Grand Prairie, TX 75050 (at least as early as Apr. 14, 2015).

* cited by examiner

FIG. 1
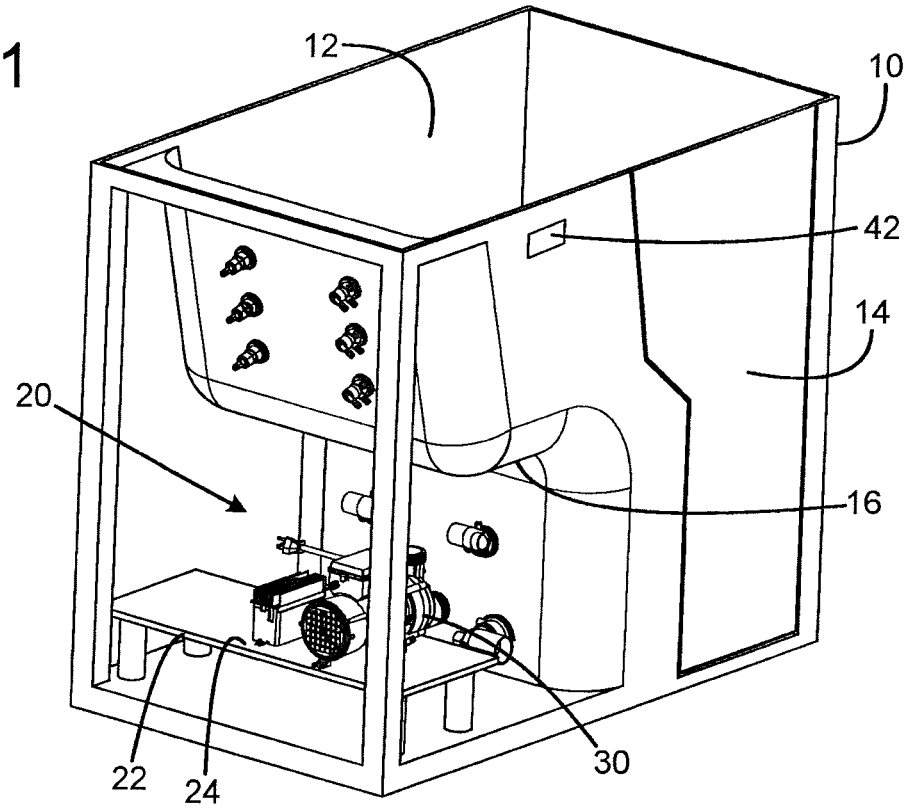
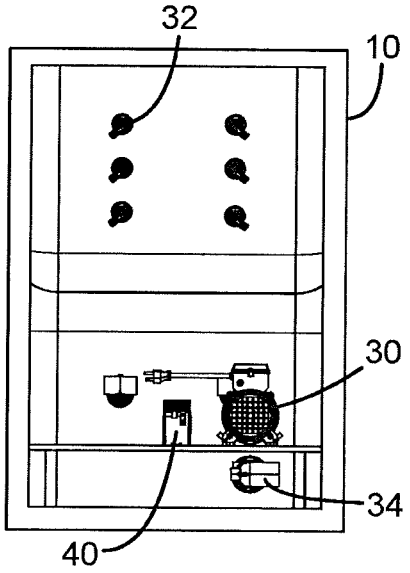
FIG. 2
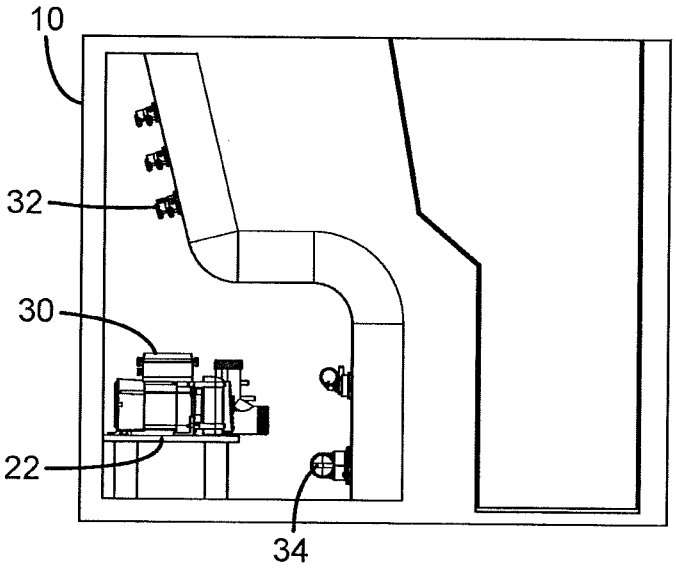
FIG. 3

RECONFIGURABLE WATER DISTRIBUTION SYSTEM FOR A WALK-IN TUB BATHING INSTALLATION WITH A SINGLE PUMP FOR MULTIPLE FUNCTIONS

CROSS-REFERENCE TO RELATED APPLICATION

This application is a continuation-in-part of U.S. patent application Ser. No. 16/195,529 filed Nov. 19, 2018, the entire contents of which are hereby incorporated by reference and of U.S. patent application Ser. No. 17/081,881, filed Oct. 20, 2020, issued Dec. 29, 2020 as U.S. Pat. No. 10,874,260, the entire contents of which are hereby incorporated by reference.

BACKGROUND

Walk-in bathtubs provide easier ingress and egress through a water-tight, hinged door, and provide a seat for the bather. In walk-in bathtubs, there are multiple types of therapies and functions which can be provided, such as a whirlpool system with bath jets, a micro nano bubbles system with small jets, an air system, lights, heating pads, and a rapid water discharge system.

In the current walk-in baths on the market, the whirlpool, micro nano bubbles and rapid water discharge systems each require a separate pump. This is a two-fold problem as the pumps are expensive and there is very limited real estate underneath the bathtub to fit the components, plumbing and the electronics to operate the tub. The available space is generally confined to a compartment below the seat.

BRIEF SUMMARY OF THE INVENTION

The present invention meets a need in the walk-in bath tub art by providing a bath tub with a reconfigurable water distribution system for selective operation of multiple functions independently with a single pump, and more particularly, for selectively independently providing through MNB jets a MNB micro-nano bubble function in the bath water held in the water reservoir, a pressurized water flow through the bath jets into the water reservoir, and a rapid water discharge mode to prepare for bather exiting of the walk-in bath tub. The present invention provides a reconfigurable water distribution system for a walk-in bath tub, comprising a motorized pump having an inlet connected to a suction port of a water reservoir of a walk-in bath tub and an outlet for delivering pressurized water during operation of the pump. A first valve has an inlet for receiving pressurized water from the pump, a first outlet for communicating pressurized water to a second valve, and a second outlet for communicating pressurized water to a drain, with the first valve selectively movable to a first position for communicating pressurized water through the first outlet for a selected one of a plurality of bathing functions and to a second position for communicating pressurized water through the second outlet for selective rapid draining function of the water reservoir. The second valve has an inlet for receiving pressurized water from the first valve and selectively positioned for communicating pressurized water selectively to a first piping system for a first type of bathing function and to a second piping system for a second type of bathing function. A controller connects to the first valve for moving between the first position or the second position for communicating pressurized water selectively and connects to the second valve for communicating pressurized water to the first piping system or to the second piping system when the first valve is in the first position, whereby the reconfigurable water distribution system selectively provides multiple operational bathing functions independently with one pump.

In another aspect, the present invention provides a walk-in bath tub with a reconfigurable water distribution system for operation with a single pump of a selected one of a plurality of bathing functions, comprising a motorized pump having an inlet connected to a suction port of a water reservoir of a walk-in bath tub and an outlet for delivering pressurized water during operation of the pump. A first T valve has an inlet for receiving pressurized water from the pump, a first outlet for communicating pressurized water to a second T valve, and a second outlet for communicating pressurized water to a drain for a bathing drain function, the first T valve selectively movable to a first position for communicating pressurized water through the first outlet for a selected one of a plurality of bathing functions and to a second position for communicating pressurized water through the second outlet for selective rapid draining of the water reservoir for the bathing drain function. A second T valve has an inlet for receiving pressurized water from the first T valve and selectively positioned for communicating pressurized water selectively to a first piping system having a first bath jet configured flowing micro bubbles into the water reservoir for a micro bubbles bathing function and to a second piping system having a plurality of second bath jets configured for jetting pressurized water into the water reservoir for a jetting bathing function. A controller connects to the first T valve for moving between the first position or the second position for communicating pressurized water selectively and connects to the second valve for communicating pressurized water to the first piping system or to the second piping system when the first valve is in the first position, whereby the reconfigurable water distribution system selectively provides three operational bathing functions independently with one pump.

In another aspect, the present invention provides a method of distributing water for independent selectable one of multiple bathing functions for a walk-in bath tub, comprising the steps of:

(a) providing a motorized pump having an inlet connected to a suction port of a water reservoir of a walk-in bath tub and an outlet for delivering pressurized water during operation of the pump;

(b) positioning a first valve to a first position for communicating pressurized water through the first outlet for a selected one of a plurality of bathing functions and to a second position for communicating pressurized water through the second outlet for selective rapid draining bathing function of the water reservoir, the first valve having an inlet for receiving pressurized water from the pump;

(c) positioning the second valve for communicating pressurized water selectively to a first piping system for a first type of bathing function and to a second piping system for a second type of bathing function, the second valve having an inlet for receiving pressurized water from the first valve, and (d) operating a controller for moving the first valve between the first position or the second position for communicating pressurized water selectively and for moving the second valve for communicating pressurized water to the first piping system or to the second piping system when the first valve is in the first position, whereby the reconfigurable water distribution system selectively provides multiple operational bathing functions independently with one pump.

In another aspect, the present invention provides a reconfigurable water distribution system for a walk-in bath tub, comprising a motorized pump having an inlet connected to a suction port of a water reservoir of a walk-in bath tub and an outlet for delivering pressurized water during operation of the pump. A valve has an inlet for receiving pressurized water from the pump and selectively positioned at least in a first position and a second position for communicating the pressurized water to one of a plurality of outlet ports for a respective bathing function for walk-in bathtubs, said plurality of bath tub functions comprising at least a quick drain function communicating the pressurized water to a sanitary drain and at least a bathing function communicating the pressurized water into the reservoir. A controller connects to the valve for moving the valve between the first position and the second position for communicating pressurized water selectively to one of the outlet ports of the first position and the second position, whereby the reconfigurable water distribution system selectively provides a plurality of operational bath tub functions independently with one pump.

BRIEF DESCRIPTION OF THE DRAWINGS

Objects, advantages, and features of the present invention according of eh present disclosure will readily be appreciated by persons skilled in the art upon a reading of the following detailed description in conjunction with the drawings.

FIG. 1 illustrates in a partially broken-away, diagrammatic isometric view an exemplary embodiment of a walk-in tub installation.

FIG. 2 illustrates in a diagrammatic end view the tub installation of FIG. 1.

FIG. 3 illustrates in a partially broken-away, diagrammatic side view the tub installation of FIG. 1.

DETAILED DESCRIPTION

Figure 4:
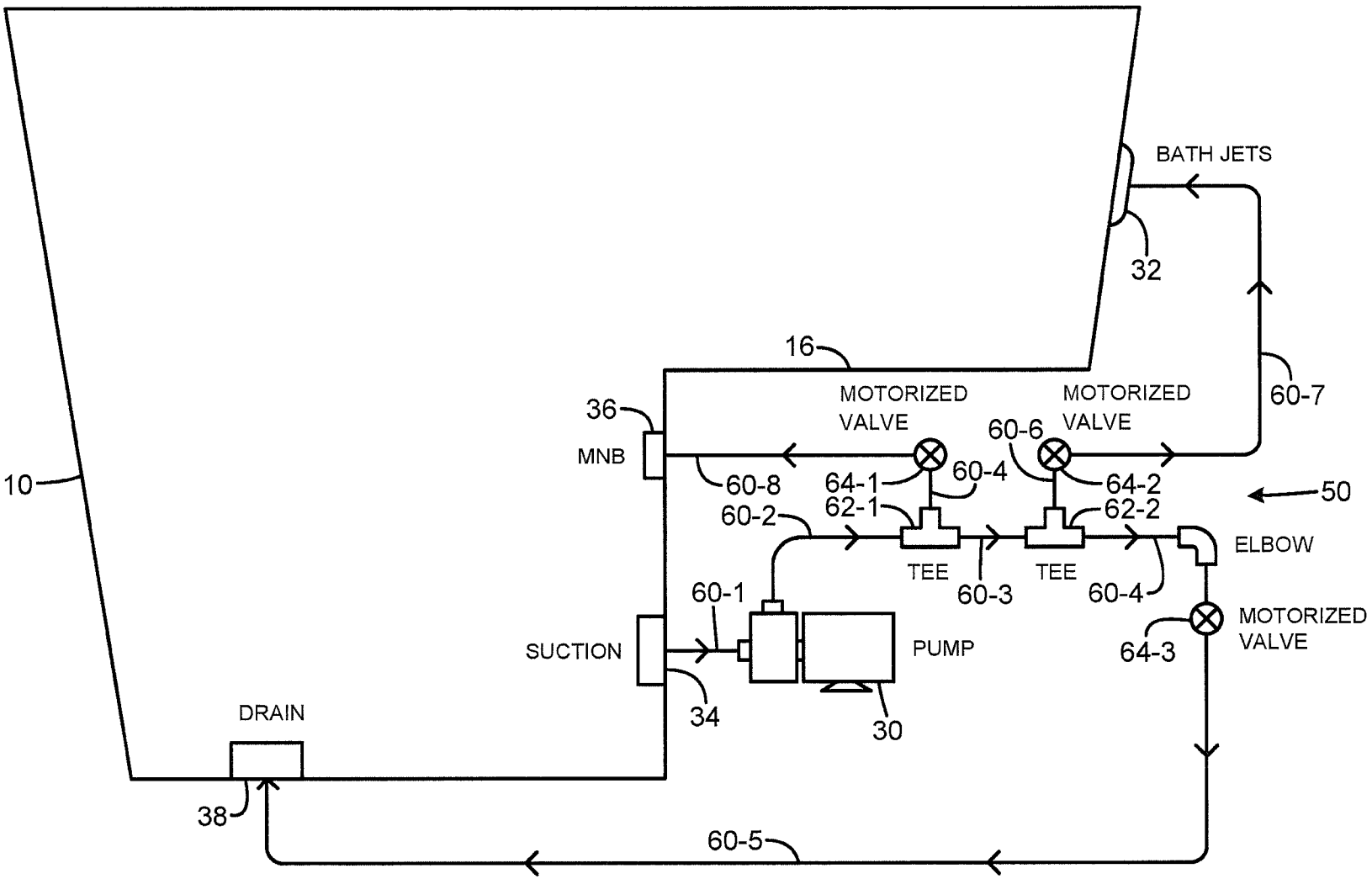
FIG. 4 illustrates in a simplified schematic diagram an exemplary embodiment of a water distribution system employing a single pump to operate three functions in a walk-in tub installation.

In the following detailed description and in the several figures of the drawing, like elements are identified with like reference numerals. The figures are not to scale, and relative feature sizes may be exaggerated for illustrative purposes.

A walk-in tub installation is shown in FIGS. 1-3. The installation includes a tub structure 10 which includes a water reservoir 12 defined by the tub structure, and a door 14 which swings on hinges from a water-tight closed position (shown in FIGS. 1-3), and an open position which allows the user ready egress into and from the water reservoir. Typically, the tub structure 10 defines a seat platform 16 for the user to sit while bathing with the door closed, and water filling the reservoir to a comfortable level for the user. Manual valve elements (not shown in FIGS. 1-3) allow the user to control the filling of the bathing water into the tub reservoir.

The tub structure 10 defines an open space 20 under and behind the seat 16, into which the tub installation pump, control and water pipes are installed. This space can be quite limited in volume, with the installation equipment mounted to a platform 22. The equipment includes a motor driven pump 30, and an electronic controller unit 24. A user interface control panel 42 is positioned for ready access by the user, to control operation of the tub functions.

The tub installation includes a network of water jets 32, through which water is pumped by the pump under pressure to provide a therapeutic effect for the user. A recirculating water flow path is provided, with the pump drawing bathing water from the reservoir through a suction fitting 34, and direct pressurized water from the pump to the water jets 32. This is a first function provided by the installation.

Another function which may be implemented in an exemplary embodiment is a rapid water discharge function, activated by the user once finished bathing, to actively pump water out from the reservoir into the drain, to speed up the tub drain process so that the user when finished bathing, may open the door 14 without water escaping through the door opening. This function may be implemented by use of the pump 30 as well, without requiring a separate pump dedicated to the rapid water discharge function.

Another function which may be implemented in an exemplary embodiment is a micro-nano bubble (MNB) function, in which water and entrained air is forced through a small jet or a network of small jets, typically known as MNB jets, positioned in the tub walls. This function delivers air-entrained water to the small jets, creating a milk-water effect. This MNB function may be implemented in an exemplary embodiment without requiring a separate pump dedicated to this function. In this embodiment, air is entrained in the water at the pump.

In accordance with aspects of the invention, two or more functions can be realized in a bathing installation, such as a walk-in tub, with a reconfigurable water distribution system including a pipe network, a single pump and one or more valves, typically motorized valves controlled by the controller 24, in accordance with user commands entered on a control panel mounted on the tub structure. The valves are typically controlled by signals from the controller 24. Several embodiments are described below, with respect to FIGS. 4-10.

FIG. 4 illustrates in schematic form a walk-in tub installation employing a reconfigurable water distribution system 50 which provides three functions, a water jet function, an MNB function and a rapid water discharge, with a single pump 30. In this embodiment, the functions may be performed one at a time, with the function selected by the setting of three valves 64-1, 64-2 and 64-3 arranged in the pipe network. The pipe network in this embodiment includes several sections. Pipe section 60-1 connects between the suction fitting in the tub wall to the suction port of the pump 30, and allows water to be drawn from the reservoir for pumping from the suction port through the pump. Pipe section 60-2 connects to a T fitting 62-1, with the T port connected to pipe section 60-4, and the through port connected to pipe section 60-3. The pipe section 60-4 is connected to a port of a two-port motorized valve 64-1; the other port of the valve is connected to pipe manifold section 60-8, which is connected to the MNB jets 36. The valve 64-1 in this embodiment is an on-off valve, so that in the off position, no water or air flows through the valve, and in the on position, water and air flow is permitted to the jets 36. If there is a single MNB jet, the section 60-8 will be connected directly to the MNB jet; if there is a plurality of MNB jets, section 60-8 can be a pipe manifold with a separate output for each MNB jet.

The system 50 further includes a second T fitting 62-2, with an inline port connected to the pipe section 60-3, a T port connected to pipe section 60-6, and the opposite inline port connected to pipe section 60-4, whose opposite end is connected through an elbow fitting to an input port of a motorized valve 64-3. The opposite end of pipe section 60-6 is connected to an input port of another motorized valve 64-2. The output port of valve 64-2 is connected to a pipe manifold 60-7, which serves the array of bath jets 32, or, in the case of a single bath jet, directly to the bath jet. The output port of valve 64-3 is connected to pipe section 60-5, whose terminal end is connected to a drain 38 for the tub. Typically, the drain connection will be to an overflow connection for the tub, so that water can be discharged whether the tub drain stopper is in place or not, for example, as described in U.S. Pat. No. 8,549,678, for an accelerated tub drain for a walk-in tub installation, the entire contents of which are incorporated herein by this reference.

The reconfigurable system 50 is configured to provide three functions, the MNB jet function, the water jet function, or the fast water discharge function, with a single pump. For the MNB function, the valve 64-1 is set to the on position, and valves 64-2 and 64-3 are set to the off position. With the pump operating, the entire pump discharge is sent to the MNB jets, and no water is sent to the jets 32 or to the drain. For the jet function, valves 64-1 and 64-3 are closed, and valve 64-2 is opened, sending all water to the bath jets 32 while the pump is operating. For the fast water discharge function, valves 64-1 and 64-2 are closed and valve 64-3 is opened, sending all water from the pump to the drain 38 while the pump is operating.

The pipe sections may be rigid pipe sections, flexible pipe sections or a combination of rigid and flexible. The valves are connected to the controller 40, which supplies control signals to the valves.

Figure 5:
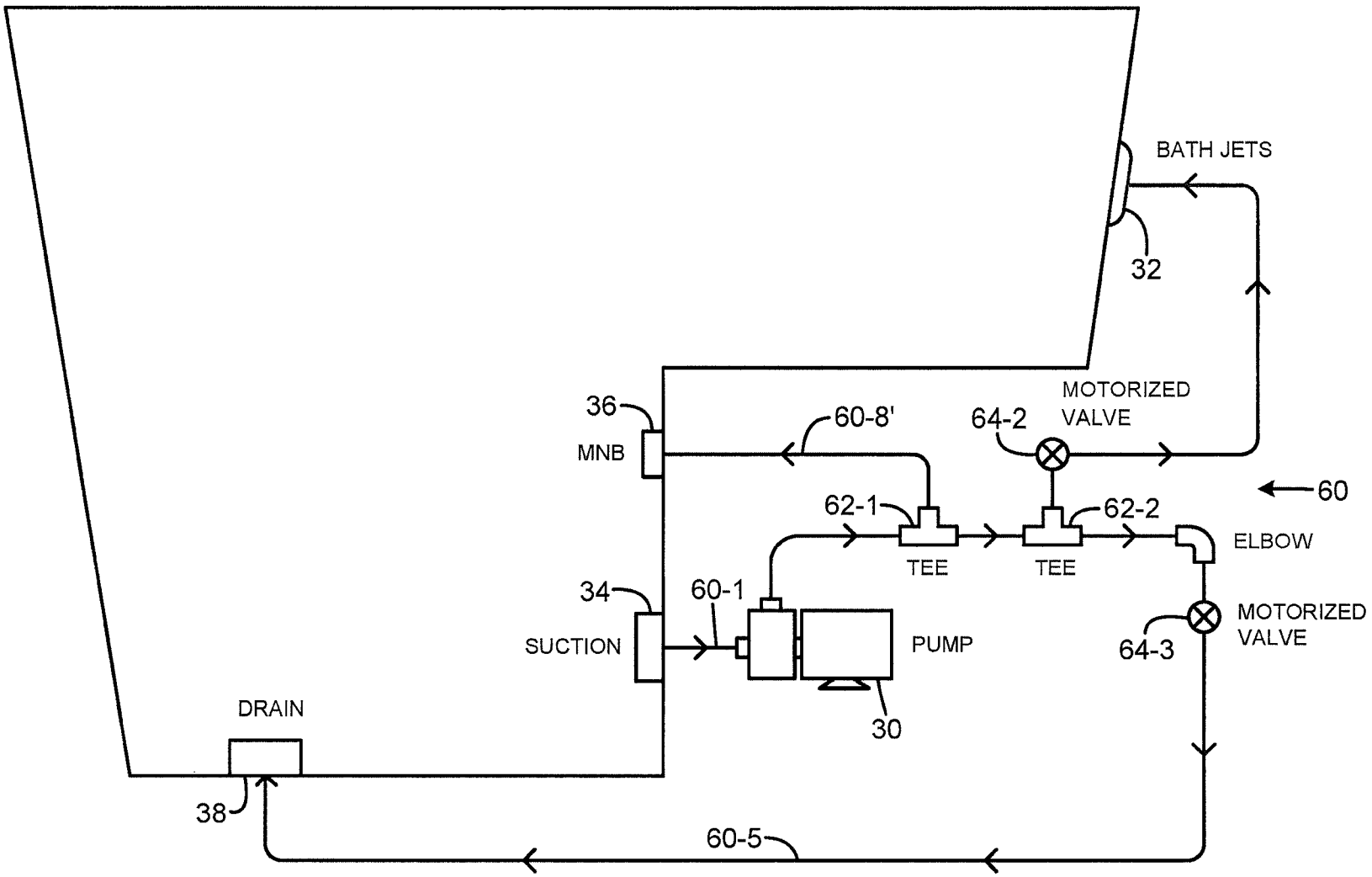
FIG. 5 illustrates in a simplified schematic diagram an alternate exemplary embodiment of a water distribution system employing a single pump to operate three functions in a walk-in tub installation.

FIG. 5 illustrates an alternate embodiment of a tub system configured for three function usage with a single pump, using a reconfigurable water distribution system 60, using only two valves 64-2 and 64-3. The system 60 is similar to system 50 (FIG. 4), except that the valve 64-1 is omitted, and the MNB pipe manifold 60-8' is connected directly to the T port of T fitting 62-1. In this embodiment, the MNB function is always active when the pump 30 is running. With valves 64-2 and 64-3 in the closed position, all water from the pump is sent to the pipe manifold 60-8'. For the bath jet function, valve 64-2 is put to the open position, and valve 62-3 to the closed position. In this configuration, some water is sent to the MNB jets, but most will be sent to the bath jets 32. For the fast water discharge function, valve 64-2 is put to the closed position, and valve 64-3 is opened. In this configuration, some water is sent to the MNB jets, but most will be sent to the drain 38.

Figure 6:
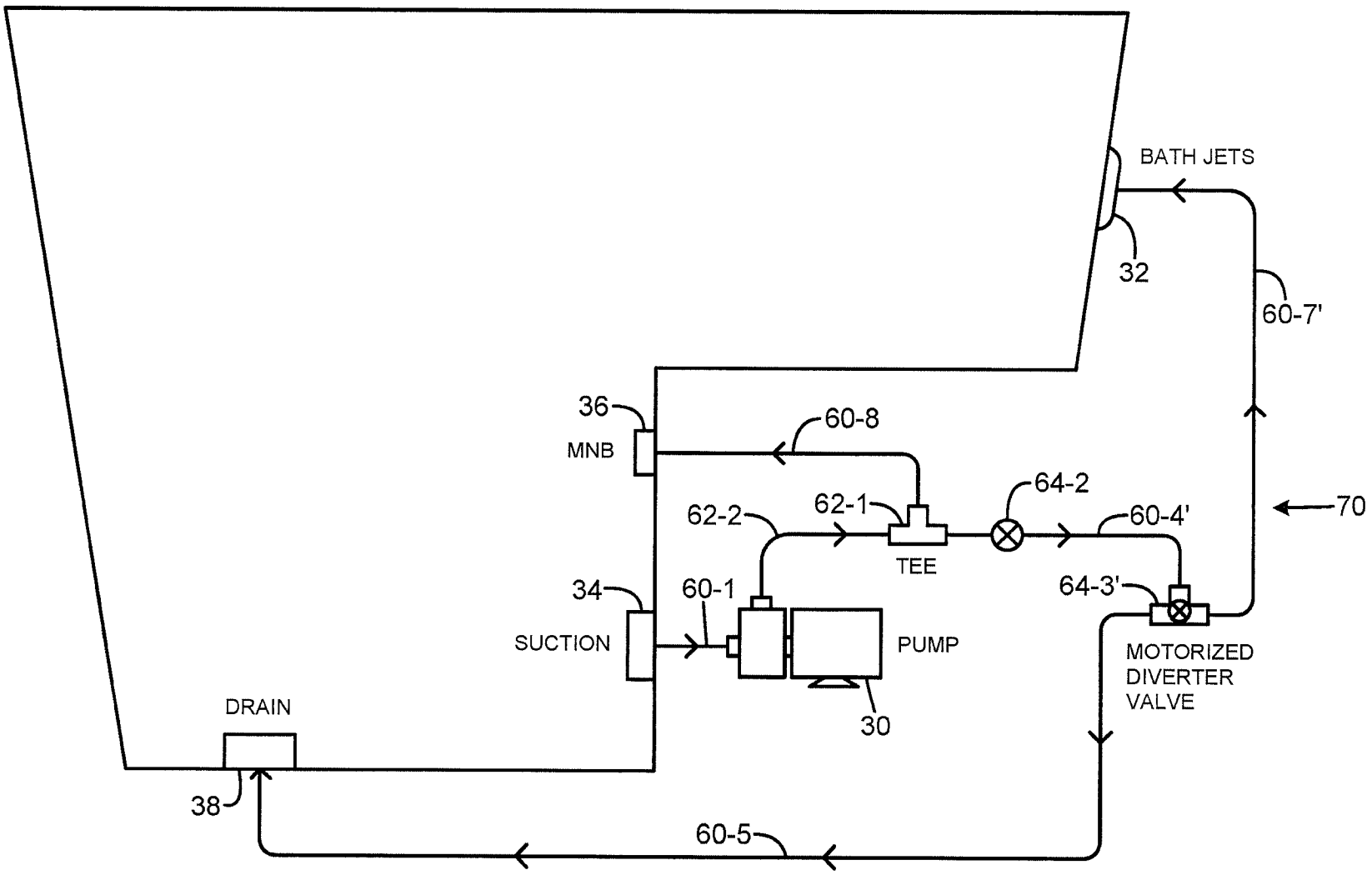
FIG. 6 illustrates in a simplified schematic diagram another exemplary embodiment of a water distribution system employing a single pump to operate three functions in a walk-in tub installation.

FIG. 6 illustrates another embodiment of a tub system with a reconfigurable water distribution system 70, configured to operate three functions with a single pump 30. The system 70 is similar to system 60 of FIG. 5, except that motorized valve 64-2 is moved and placed in the pipe section 60-4', valve 64-3 is replaced with a diverter valve 64-3', and pipe manifold section 60-7 is replaced with pipe manifold section 60-7' connected one output port of the valve 64-3', the other output connected through pipe section 60-5 to the drain 38. The diverter valve 64-3' has two settings, one in which the input port is connected to the output port connected to the bath jet manifold pipe section 60-7', and a second setting in which the input port is connected to the output port connected to the pipe section 60-5. In this embodiment, the MNB jet function is always active when the pump is opened. For an MNB function only, the motorized valve 64-2 is closed, so that all water from the pump is directed to the MNB jets 36. The bath jet function is selected by placing valve 64-2 in the open position, and setting the diverter valve to direct flow to the bath jets. Some water flows to the MNB jets, but most will flow to the bath jets. For the rapid water discharge function, valve 64-2 is opened, and the diverter valve is set to direct water to the port connected to the pipe section 60-5. Again, some water will flow to the MNB jets, but most will flow to the drain for discharge.

Figure 7:
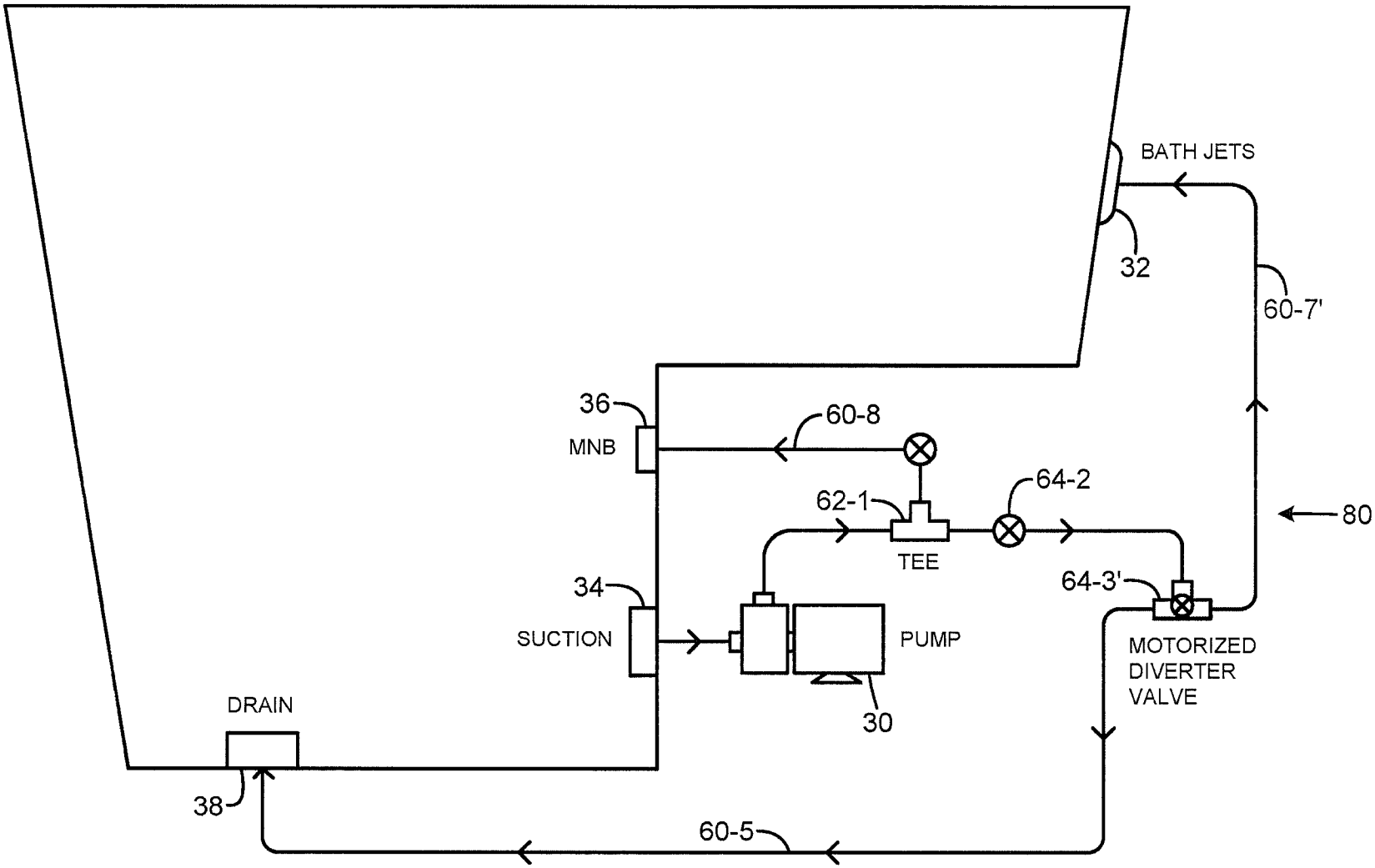
FIG. 7 illustrates in a simplified schematic diagram yet another exemplary embodiment of a water distribution system employing a single pump to operate three functions in a walk-in tub installation.

FIG. 7 shows in schematic form another embodiment of a tub system with a reconfigurable water distribution system. The system 80 uses two motorized open/close valves 64-1 and 64-2, and a motorized diverter valve 64-3'. The water distribution system is similar to that of system 70 (FIG. 6), except that the valve 64-1 is placed between the T fitting 62-1 and the pipe manifold section 60-8. This allows the path to the MNB jets to be closed when the system 80 is in the bath jets function mode or in the rapid water discharge mode.

Figure 8:
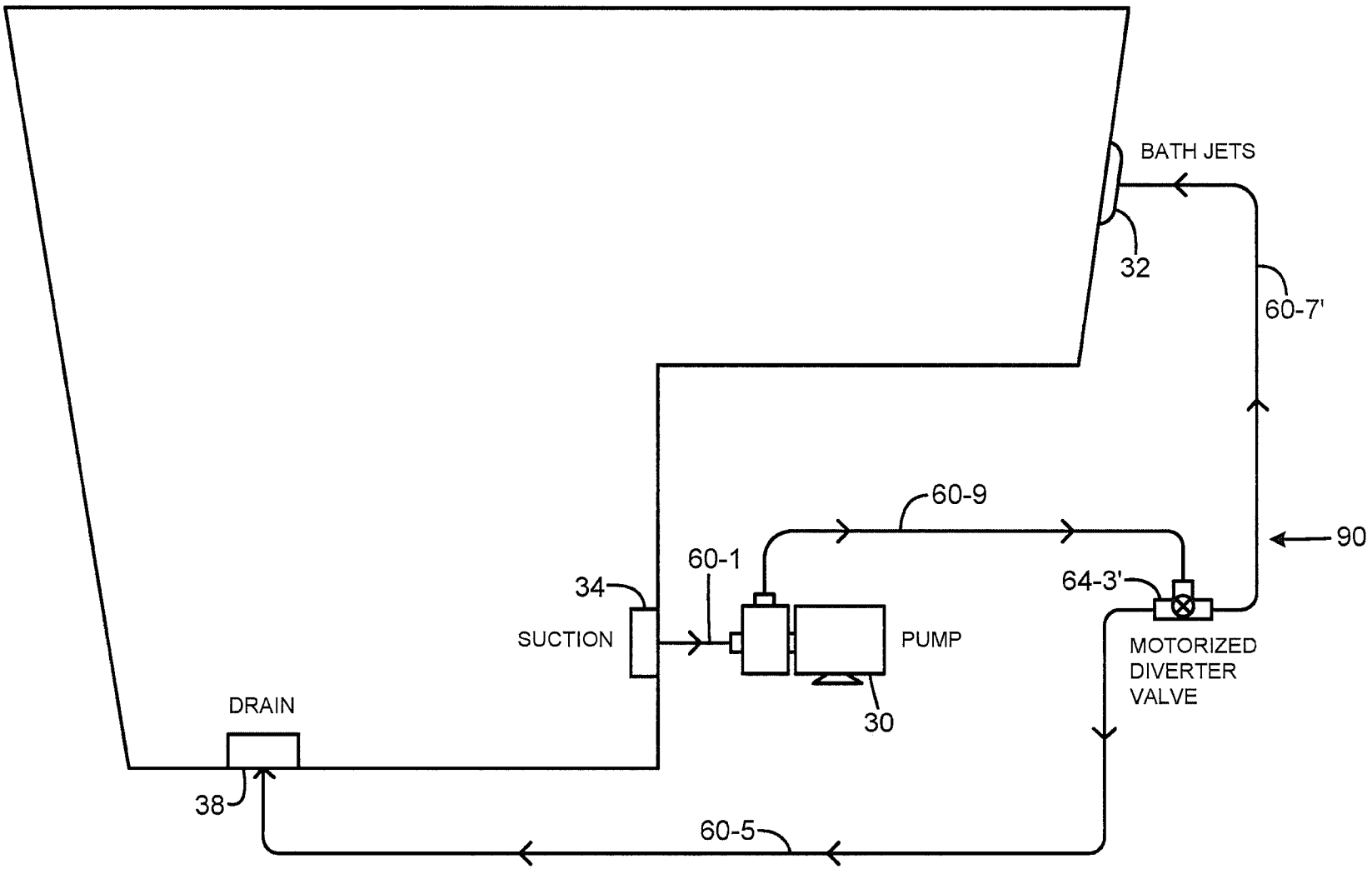
FIG. 8 illustrates in a simplified schematic diagram an exemplary embodiment of a water distribution system employing a single pump to operate two functions in a walk-in tub installation.

FIG. 8 illustrates a tub installation with a reconfigurable water distribution system 90, in which the tub does not include MNB jets. The system 90 provides two functions or mode of operation, a bath jet mode and a rapid water discharge mode, using a single pump 30, using a single diverter valve. In this embodiment, the pump pressure port is connected to pipe section 60-9, which runs to the input port of the diverter valve 64.-3'. One output port of the valve is connected to pipe manifold section 60-7', which is connected to the bath jets 32. The other output port of the diverter valve is connected to the drain by pipe section 60-5. The two modes of operation are selected by the position of the diverter valve 64-3', to thus provide either a bath jet mode or a rapid water discharge mode when the pump is operating.

Figure 9:
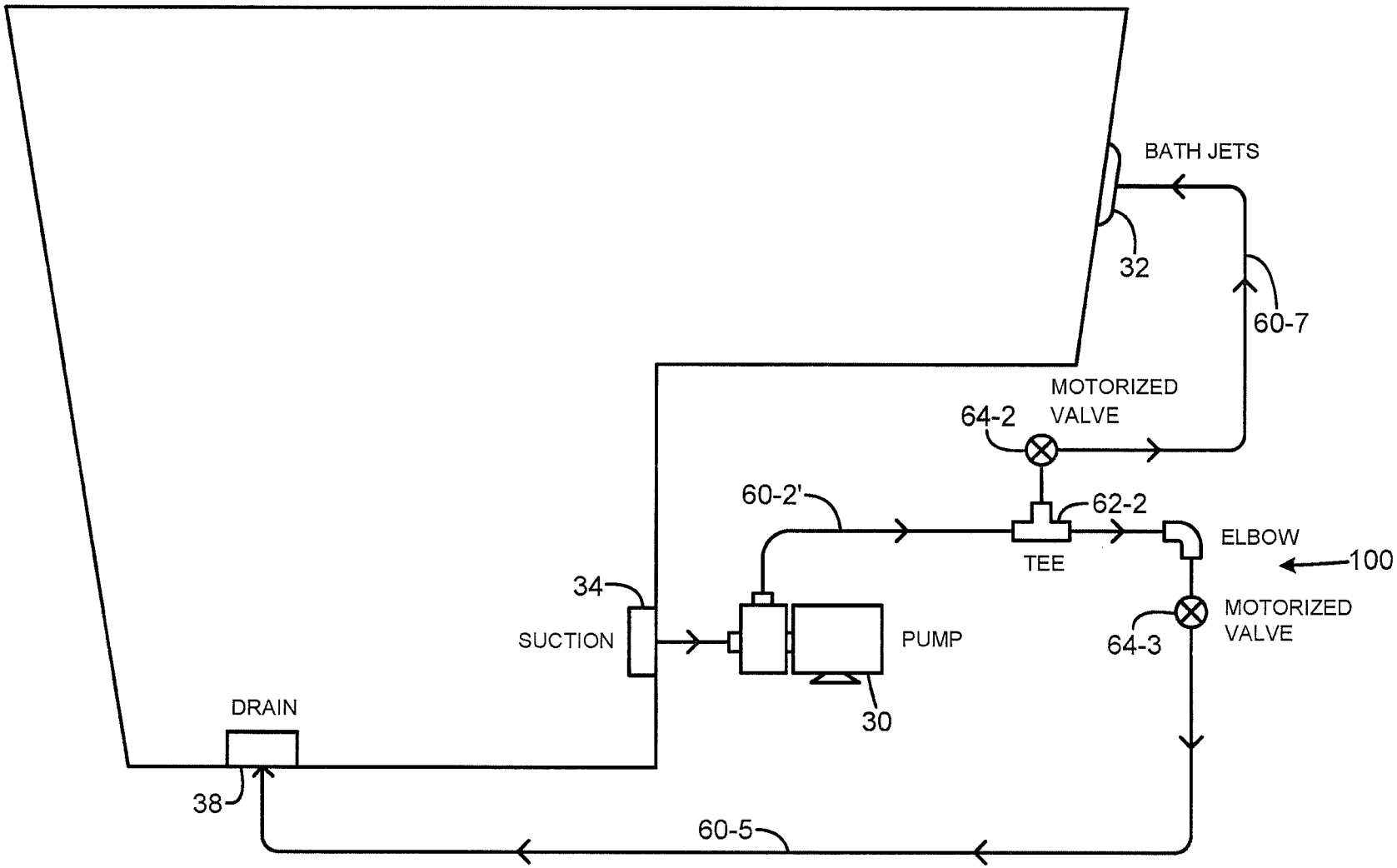
FIG. 9 illustrates in a simplified schematic diagram a second exemplary embodiment of a water distribution system employing a single pump to operate two functions in a walk-in tub installation.

FIG. 9 illustrates a tub installation with a reconfigurable water distribution system 100, in which the tub does not include MNB jets. The system 100 provides two functions or mode of operation, a bath jet mode and a rapid water discharge mode, using a single pump 30, using two motorized open/close valves. The system 110 is similar to system 50 (FIG. 4), except that the valve 64-1 and T fitting 62-1 are omitted. Pipe section 60-2' connects the pump output directly to the T fitting 62-2. To select the bath jets mode, valve 64-2 is opened, and valve 64-3 is closed, sending the entire output of the pump to the bath jets. To select the rapid water discharge mode, valve 64-2 is closed, and valve 64-3 is opened, sending the entire output of the pump to the drain. If both valves are opened, water will be distributed between the bath jets and the drain. Alternatively, the valve 64-2 may be connected to the drain fitting, and valve 64-3 connected to the bath jets, in any of the foregoing embodiments.

Figure 10:
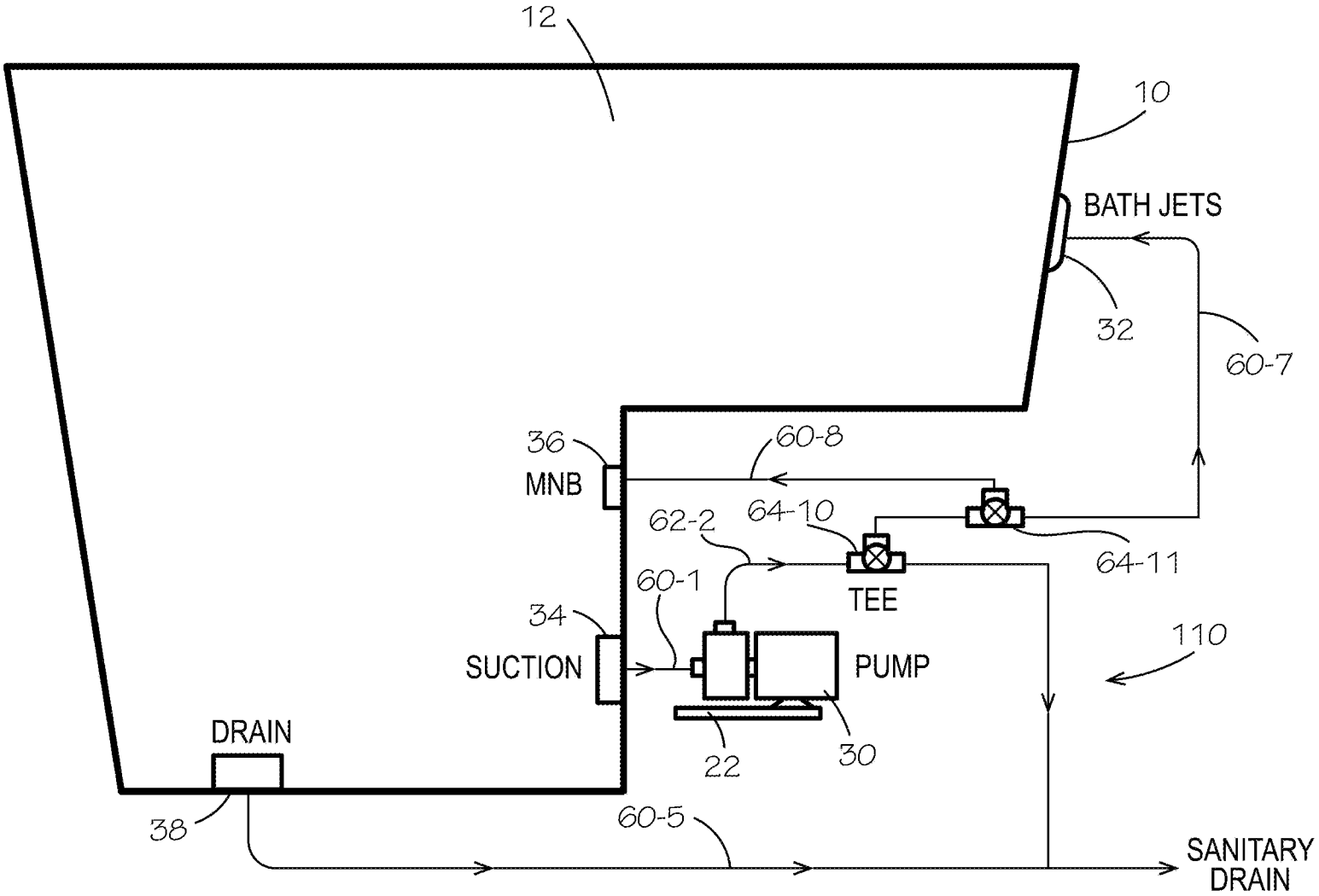
FIG. 10 illustrates in a simplified schematic diagram yet another exemplary embodiment of a water distribution system employing a single pump to operate three functions independently in a walk-in tub installation.

FIG. 10 illustrates yet another embodiment of a tub system with a reconfigurable water distribution system 110, configured to operate three bath tub functions with a single pump 30. In this embodiment, the three bath tub functions are selectively independently operative for providing a MNB micro-nano bubble bathing function in the bath water held in the water reservoir 12 through the MNB jets 36, a pressurized water flow bathing function into the water reservoir 12 through the bath jets 32, and a rapid water discharge bath function mode, using the single pump 30 and two motorized T valves 64-10 and 64-11. The operative function of the pressurized water flow into the bath water through the bath jets 34 have a destabilizing influence on the MNB micro-nano bubbles and the bubbles collapse in the pressurized water flow rather than flow freely upwardly in the bath water. The motorized T valves 64-10 and 64-11 each have an inlet port and two selective outlet ports. Water flows into the valve through the inlet and out through one of the two selective outlet ports. The pipe section 60-1 connects between the suction fitting 34 in the tub wall to the suction port of the pump 30, and allows water to be drawn from the water reservoir 12 for pumping from the suction port through the pump. The pipe section 60-2 connects to the inlet of the first motorized T valve 64-10. A first T port connects with a pipe section 60-10 to an inlet of the second motorized T valve 64-11. A second T port connects to the pipe section 60-5 to a drain. The floor drain 38 of the reservoir 12 connects to the drain (such as to the pipe section 60-5). A first outlet of the second motorized T valve 64-11 connects with the pipe section 60-8 to the MNB jets 36. A second outlet of the second motorized T valve 64-11 connects with the pipe section 60-7 to the pressurized flow bath jets 32. The electronic controller 24 connects to the interface control panel 42 and the motorized T valves 64-10 and 64-11 for selective operation of the three functions or operating modes for MNB treatment, pressurized jets, or rapid water discharge in preparation for the bather to exit the bath tub 10.

The electronic controller 24 operates the first and second motorized T valves 64-10 and 64-11. The first motorized T valve 64-10 is biased to a first position for directing water from the first outlet through the connector pipe 60-10 to the inlet of the second motorized T valve 64-11. This closes or prevents water flow from the second outlet of the first T valve 64-10 to the drain through the drain pipe 60-5. The second motorized T valve is selectively positioned for water flow outwardly from the first outlet to the MNB jet 36 or from the second outlet to the pressurized flow jets 32. The interface control panel 42 displays the operative status or position of the second T valve. Alternatively, the second T valve 64-11 may be biased to one function or the other.

Upon filling of the water reservoir 12, the water distribution system 110 illustrated in FIG. 10 operates to provide independently the MNB micro-nano bubble bathing function, the pressurized jets bathing function, and the rapid water discharge bathing function, selectively. The water distribution system 110 in an illustrative implementation biases the first T valve 64-10 for directing pressurized water from the pump 30 to the second T valve 64-11. The first T valve 64-10 thus is closed to flow of water to the drain. The interface control panel 42 may be operated to select MNB jet 34 function or pressurized jet 32 function. Upon selection of the MNB jet function, the pump 30 if operating stops. The motorized T valve 64-11 moves to direct water flow to the first outlet for communication pressurized water through the connector pipe 60-8 to the MNB jets 36 and into the bath water of the reservoir. The pump 30 then starts and micro-nano bubbles flow through the MNB jet 36 into the bath water.

Upon selection of the pressurized jet bathing function, the pump 30 if operating stops. The motorized T valve 64-11 moves to direct water flow to the second outlet for communication of pressurized water through the connector pipe 60-7 to the bath jets 32 and into the bath water of the reservoir. The pump 30 starts and the pressurized water jets into the bath water. The bather may alternate the selection of the independent MNB jet or pressurized jet water flow for bathing functions.

To exit the bath tub, the bather selectively operates a fast drain switch on the interface control panel 42. In the illustrative embodiment, the switch is held for a predetermined period such as 3 seconds. The interface control panel 42 then prepares for raid drain function of the bath water for bather egress. The pump 30 if operating stops. The first T valve 64-10 operates to move to a second water flow position. This closes the first outlet and opens the second outlet for communicating water to the drain through the drain pipe 60-5. The pump 30 then starts and pressurized water flows from the pump through the supply pipe 60-2 into the inlet of the T valve 64-10 and out of the second outlet to the drain pipe 60-5 and to the drain. The first T valve 64-10 being closed to the first outlet does not communicate pressurized water to the second T valve 64-11. The pump 30 operates for a predetermined period to drain water from the water reservoir. Preferably the pump operates for a period sufficient to lower the water level below a threshold of the door to the water reservoir. This allows bather egress through the door of the walk-in bath tub. The pump stops. Residual water drains through the floor drain 38 to the drain. The interface control panel 42 then operates to move the first T valve 64-10 to the first position closing the second outlet to the drain and opening the first outlet for communicating water to the second T valve 64-11. The bath tub 10 is then ready for a subsequent filling of the water reservoir and bathing.

Figure 11:
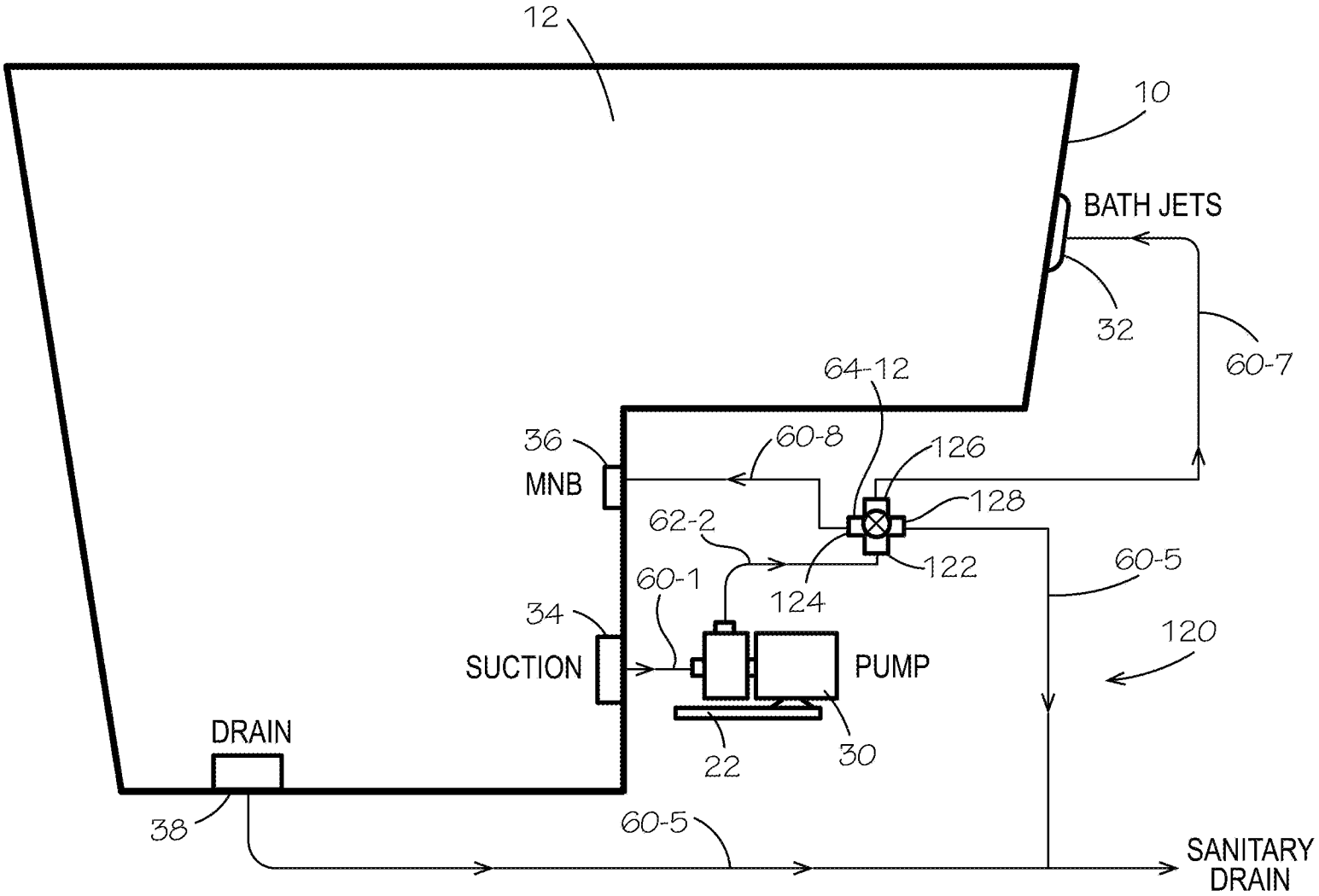
FIG. 11 illustrates in a simplified schematic diagram yet another exemplary embodiment of a water distribution system employing a single pump to operate three functions independently in a walk-in tub installation.

FIG. 11 illustrates yet another embodiment of a tub system with a reconfigurable water distribution system 120, configured with a bottom-entry single "L" 4 way valve 64-12 to operate three bath tub functions with a single pump 30. The valve 64-12 has an inlet port 122 and three selectable outlet ports 124, 126, and 128. The pump 30 provides pressurized water to the inlet port 122 of the valve 64-12. The outlet ports of the valve 64-12 provides three bathing functions selectively independently operative for communicating water through outlet port 124 to provide a MNB micro-nano bubble bathing function in the bath water held in the water reservoir 12 through the MNB jets 36, though outlet port 126 for pressurized water flow bathing function into the water reservoir 12 through the bath jets 32, and though outlet port 126 for a rapid water discharge or drain function mode, using the single pump 30 and the valve 64-12.

The water flows into the valve 64-12 through the inlet 122 and out through one of the three outlet ports 124, 126, or 128. The pipe section 60-1 connects between the suction fitting 34 in the tub wall to the suction port of the pump 30, and allows water to be drawn from the water reservoir 12 for pumping from the suction port through the pump. The pipe section 60-2 connects to the inlet 122 of the valve 64-12. The outlet port 124 connects with the pipe section 60-8 to the MNB microbubbles generator 36. The outlet port 126 connects to the pipe 60-7 to the bath jets 32. The outlet port 128 connects with the pipe section 60-5 to a sanitary drain. The floor drain 38 of the reservoir 12 also connects to the drain (such as to the pipe section 60-5). The electronic controller 24 connects to the interface control panel 42 and the motorized controller for the valve 64-12 for selective operation of the three bathing functions or operating modes for MNB treatment, pressurized jets, or rapid water discharge in preparation for the bather to exit the bath tub 10.

With reference to FIG. 11, the electronic controller 24 operates the valve 64-12. The valve 64-12 is biased to the first position for directing water from the outlet 126 to the bath jets 32. The valve 64-12 selectively operates for MNB microbubbles bathing function or for quick draining bathing function for bather egress. The interface control panel 42 may display the operative status or position of the valve 64-12.

Upon filling of the water reservoir 12, the water distribution system 110 illustrated in FIG. 11 operates to provide independently the MNB micro-nano bubble bathing function, the pressurized jets bathing function, and the rapid water discharge draining bathing function, selectively. The water distribution system 120 in an illustrative implementation biases the valve 64-12 for directing pressurized water from the pump 30 to bath jets 32. This allows filling of the bath tub for bathing use. The interface control panel 42 may be operated to select MNB jet 34 bathing function or pressurized jet 32 bathing function. Upon selection of the MNB jet function, the pump 30 if operating stops. The valve 64-12 moves to direct water flow to the outlet 124 for communication pressurized water through the connector pipe 60-8 to the MNB jets 36 and into the bath water of the reservoir. The pump 30 then starts and micro-nano bubbles flow through the MNB jet 36 into the bath water.

Upon selection of the pressurized jet function, the pump 30 if operating stops. The valve 64-12 moves to direct water flow to the outlet 126 for communication of pressurized water through the connector pipe 60-7 to the bath jets 32 and into the bath water of the reservoir. The pump 30 starts and the pressurized water jets into the bath water. The bather may alternate the selection of the independent MNB jet or pressurized jet water flow for bathing functions.

To exit the bath tub, the bather selectively operates a fast drain switch on the interface control panel 42. In the illustrative embodiment, the switch is held for a predetermined period such as 3 seconds. The interface control panel 42 then prepares for raid drain bathing function of the bath water for bather egress. The pump 30 if operating stops. The valve 64-12 operates to move to the quick drain position for outlet 128. The pump 30 then starts and pressurized water flows from the pump through the supply pipe 60-2 into the valve 64-12 and out of the outlet port 128 to the drain pipe 60-5 and to the sanitary drain. The pump 30 operates for a predetermined period to drain water from the water reservoir. Preferably the pump operates for a period sufficient to lower the water level below a threshold of the door to the water reservoir. This allows bather egress through the door of the walk-in bath tub. The pump stops. Residual water drains through the floor drain 38 to the sanitary drain. The interface control panel 42 then operates to move the valve 64-12 to the position for communicating through the outlet port 126 for the bath jets 32. The bath tub 10 is then ready for a subsequent filling of the water reservoir and bathing.

Although the foregoing has been a description and illustration of specific embodiments of the subject matter, various modifications and changes thereto can be made by persons skilled in the art without departing from the scope and spirit of the invention.

What is claimed is:

1. A reconfigurable water distribution system for a walk-in bath tub, comprising:

a motorized pump having an inlet connected to a suction port of a water reservoir of a walk-in bath tub and an outlet for delivering pressurized water during operation of the pump;

a first valve having an inlet for receiving pressurized water from the pump, a first outlet for communicating pressurized water to a second valve and a second outlet for communicating pressurized water to a drain, the first valve selectively movable to a first position for communicating pressurized water through the first outlet for a selected one of a plurality of bathing functions and to a second position for communicating pressurized water through the second outlet for rapid draining function of the water reservoir;

the second valve having an inlet for receiving pressurized water from the first valve and selectively positioned for communicating pressurized water to a first piping system for a first type of bathing function and to a second piping system for a second type of bathing function, a controller connected to the first valve for moving the first valve to the first position or the second position for communicating pressurized water selectively and connected to the second valve for moving the second valve selectively to the first position and to the second position for communicating pressurized water to the first piping system or to the second piping system when the first valve is in the first position, whereby the reconfigurable water distribution system selectively provides three operational bathing functions independently with one pump.

2. The reconfigurable water distribution system as recited in claim 1, wherein the first piping system connects to a discharge port in the walk-in bath tub configured for generating micro bubbles that flow into the water reservoir of the walk-in bath tub as one of the plurality of bathing functions.

3. The reconfigurable water distribution system as recited in claim 1, wherein the first piping system connects to one or more bath jets in the walk-in bath tub for discharging one or more jets of pressurized water into the water reservoir of the walk-in bath tub as one of the plurality of bathing functions.

4. The reconfigurable water distribution system as recited in claim 1, wherein the first piping system connects to a discharge port in the walk-in bath tub configured for generating micro bubbles that flow into the water reservoir of the walk-in bath tub for one of the plurality of bathing functions; and the second piping system connects to one or more bath jets in the walk-in bath tub for discharging one or more jets of pressurized water into the water reservoir of the walk-in bath tub for another one of the plurality of bathing functions.

5. The reconfigurable water distribution system as recited in claim 1, wherein the first valve and the second valve are motorized for operational control by the controller.

6. The reconfigurable water distribution system as recited in claim 1, wherein the first valve and the second valve are motorized for operational control by the controller.

7. The reconfigurable water distribution system as recited in claim 1, wherein the first valve and the second valve are each three-port valves.

8. A walk-in bath tub with a reconfigurable water distribution system for operation with a single pump of a selected one of a plurality of bathing functions, comprising:

a motorized pump having an inlet connected to a suction port of a water reservoir of a walk-in bath tub and an outlet for delivering pressurized water during operation of the pump;

a first T valve having an inlet for receiving pressurized water from the pump, a first outlet for communicating pressurized water to a second T valve, and a second outlet for communicating pressurized water to a drain for a bathing drain function, the first T valve selectively movable to a first position for communicating pressurized water through the first outlet for a selected one of a plurality of bathing functions and to a second position for communicating pressurized water through the second outlet for rapid draining of the water reservoir for the bathing drain function;

the second T valve having an inlet for receiving pressurized water from the first T valve and selectively positioned for communicating pressurized water selectively to a first piping system having a first bath jet configured flowing micro bubbles into the water reservoir for a micro bubbles bathing function or to a second piping system having a plurality of second bath jets configured for jetting pressurized water into the water reservoir for a jetting bathing function, a controller connected to the first T valve for moving the first valve to the first position or the second position for communicating pressurized water selectively and connected to the second valve for moving the second valve selectively to the first position and to the second position for communicating pressurized water selectively to the first piping system or to the second piping system when the first valve is in the first position, whereby the reconfigurable water distribution system selectively provides three operational bathing functions independently with one pump.

9. The walk-in bath tub as recited in claim 8, wherein the first bath jet further comprises a discharge port in the walk-in bath tub configured for generating micro bubbles.

10. The walk-in bath tub as recited in claim 8, wherein the plurality of second bath jets are disposed in spaced-apart relation for jetting pressurized water into the water reservoir of the walk-in bath tub.

11. The walk-in bath tub as recited in claim 8, wherein the first T valve and the second T valve are motorized for operational control by the controller.

12. The walk-in bath tub as recited in claim 8, wherein the first T valve and the second T valve are motorized for operational control by the controller, for selectively providing the bathing drain function, the micro bubbles bathing function, and the pressurized jetting bathing function, independently with one pump.

13. The walk-in bath tub water distribution system as recited in claim 8, wherein the first T valve and the second T valve are each three-port valves.

14. A method of distributing water for independent selectable one of a plurality of bathing functions for a walk-in bath tub, comprising the steps of:

(a) providing a motorized pump having an inlet connected to a suction port of a water reservoir of a walk-in bath tub and an outlet for delivering pressurized water during operation of the pump;

(b) positioning a first valve to a first position for communicating pressurized water through a first outlet for a selected one of a plurality of bathing functions and to a second position for communicating pressurized water through a second outlet for a rapid draining of the water reservoir as one of the plurality of bathing functions, the first valve having an inlet for receiving pressurized water from the pump;

(c) positioning a second valve for communicating pressurized water selectively to a first piping system for a first one of the plurality of bathing functions and to a second piping system for a second one of the plurality of bathing functions, the second valve having an inlet for receiving pressurized water from the first valve, and (d) operating a controller for moving the first valve to the first position or the second position for communicating pressurized water selectively and for moving the second valve for communicating pressurized water to the first piping system or to the second piping system when the first valve is in the first position, whereby the reconfigurable water distribution system selectively provides the plurality of operational bathing functions independently with one pump.

15. The method as recited in claim 14, further comprising the step of connecting the first piping system to a discharge port in the walk-in bath tub configured for generating micro bubbles that flow in the water reservoir of the walk-in bath tub as the one of the plurality of bathing functions.

16. The method as recited in claim 14, further comprising the step of connecting the first piping system to one or more bath jets in the walk-in bath tub for discharging one or more jets of pressurized water into the water reservoir of the walk-in bath tub as the one of the plurality of bathing functions.

17. The method as recited in claim 14, further comprising the steps of:

connecting the first piping system to a discharge port in the walk-in bath tub configured for generating micro bubbles that flow in the water reservoir of the walk-in bath tub for one of the plurality of bathing functions; and connecting the second piping system to one or more bath jets in the walk-in bath tub for discharging one or more jets of pressurized water into the water reservoir of the walk-in bath tub for another one of the plurality of bathing functions.

18. The method as recited in claim 17, further comprising the step of providing motors for operation of the first valve and the second valve by the controller.

19. The method as recited in claim 14, further comprising the step of providing motors for operation of the first valve and the second valve by the controller.

20. The method as recited in claim 19, further comprising the steps of:

connecting the first piping system to a discharge port in the walk-in bath tub configured for generating micro bubbles that flow in the water reservoir of the walk-in bath tub for the first one of the plurality of bathing functions; and connecting the second piping system to one or more bath jets in the walk-in bath tub for discharging one or more jets of pressurized water into the water reservoir of the walk-in bath tub for the second one of the plurality of bathing functions.

21. A reconfigurable water distribution system for a walk-in bath tub, comprising:

a motorized pump having an inlet connected to a suction port of a water reservoir of a walk-in bath tub and an outlet for delivering pressurized water during operation of the pump;

a valve having an inlet for receiving pressurized water from the outlet of the pump and selectively positioned at least in a first position for a quick drain function communicating the pressurized water to a sanitary drain and a second position for communicating the pressurized water to one of a plurality of types of outlet ports, each type of outlet ports for a respective one of a plurality of bath tub functions for walk-in bathtubs, said plurality of bath tub functions comprising communicating micro bubbles from a first type of outlet ports and communicating the pressurized water though a second type of outlet ports into the reservoir;

a controller connected to the valve for moving to the first position and the second position for communicating pressurized water selectively to the drain or to one of the types of outlet ports of the second position, whereby the reconfigurable water distribution system selectively provides a plurality of operational bath tub functions independently with one pump.

22. The reconfigurable water distribution system as recited in claim 21, wherein the first type of outlet ports configured for generating micro bubbles that flow with the pressurized water into the reservoir of the walk-in bath tub as the bathing function.

23. The reconfigurable water distribution system as recited in claim 21, wherein the second type of outlet ports comprises one or more bath jets in a wall of the walk-in bath tub for discharging one or more jets of pressurized water into the reservoir of the walk-in bath tub as the bathing function.

24. The reconfigurable water distribution system as recited in claim 21, wherein the valve comprises a first discharge port that connects to the first type of outlet ports in the walk-in bath tub configured for generating micro bubbles that flow into the water reservoir of the walk-in bath tub for a first bathing function, a second discharge port that connects to the second type of outlet ports comprising one or more bath jets in the walk-in bath tub for discharging respective jets of pressurized water into the water reservoir of the walk-in bath tub for a second bathing function, and a third discharge port that connects to the sanitary drain for the quick drain function.

25. The reconfigurable water distribution system as recited in claim 21, wherein the valve is motorized for operational control by the controller.

26. A method for independent distributing a flow of water in a reconfigurable water distribution system for a walk-in bath tub, comprising the steps of:

(a) providing a motorized pump having an inlet connected to a suction port of a water reservoir of a walk-in bath tub and an outlet for delivering a flow of pressurized water during operation of the pump;

(b) providing a valve having an inlet for receiving the flow of pressurized water from the pump and selectively positionable at least in a first position for communicating the pressurized water to a sanitary drain and a second position for communicating the pressurized water to one of a plurality of types of outlet ports, each type of outlet ports for a respective one of a plurality of bath tub functions for walk-in bathtubs, said plurality of bath tub functions comprising communicating micro bubbles through a first type of outlet ports into the reservoir and communicating the pressurized water through a second type of outlet ports into the reservoir; and (c) operating a controller connected to the valve for moving to the first position or to the second position for communicating the flow of pressurized water selectively to the sanitary drain or to the respective type of outlet ports of the second position, whereby the reconfigurable water distribution system selectively provides a plurality of operational bath tub functions independently with one pump.

27. The method of independent distributing as recited in claim 26, further comprising the step of connecting the first type of outlet ports to a wall in the walk-in bath tub and configured for generating micro bubbles that flow with the pressurized water into the reservoir of the walk-in bath tub as the bathing function.

28. The method of independent distributing as recited in claim 26, further comprising the step of connecting the second type of outlet ports to one or more bath jets in the walk-in bath tub for discharging one or more jets of pressurized water into the reservoir of the walk-in bath tub as the bathing function.

29. The method of independent distributing as recited in claim 26, further comprising the steps of:

connecting a first outlet port of the valve to the first type of outlet port in the walk-in bath tub configured for generating micro bubbles that flow into the water reservoir of the walk-in bath tub for a first bath tub function as a first type of the bathing function;

connecting a second outlet port of the valve to the second type of outlet port comprising one or more bath jets in the walk-in bath tub for discharging one or more jets of pressurized water into the water reservoir of the walk-in bath tub as a second type of the bathing function; and connecting a third outlet port of the valve to the sanitary drain for the quick drain function, whereby the controller selectively positions the valve for flow of pressurized water for a selected one of the plurality of operational bath tub functions independently with one pump.

30. The method of independent distributing as recited in claim 29, wherein the valve is motorized for operational control by the controller.

* * * * *